US007108044B2

(12) United States Patent
Miyamoto et al.

(10) Patent No.: US 7,108,044 B2
(45) Date of Patent: Sep. 19, 2006

(54) METHOD AND APPARATUS FOR PRODUCING MOLD

(75) Inventors: Yutaka Miyamoto, Akishima (JP); Norihiko Kikuchi, Akishima (JP)

(73) Assignee: Kikuchi Co., Ltd., Tokyo (JP)

( * ) Notice: Subject to any disclaimer, the term of this patent is extended or adjusted under 35 U.S.C. 154(b) by 172 days.

(21) Appl. No.: 10/789,185

(22) Filed: Feb. 27, 2004

(65) Prior Publication Data

US 2004/0163792 A1 Aug. 26, 2004

Related U.S. Application Data

(62) Division of application No. 10/009,903, filed as application No. PCT/JP01/03896 on May 10, 2001, now Pat. No. 6,953,077.

(30) Foreign Application Priority Data

May 24, 2000 (JP) ..... 2000-152594

(51) Int. Cl.
*B22C 19/04* (2006.01)

(52) U.S. Cl. ..... 164/154.1; 164/262; 703/1; 700/182

(58) Field of Classification Search ..... 164/154.1, 164/262, 76.1, 4.1; 703/1; 700/182
See application file for complete search history.

(56) References Cited

U.S. PATENT DOCUMENTS 5,277,529 A 1/1994 Anders et al.
5,680,317 A * 10/1997 Watanabe ..... 703/1
6,155,331 A * 12/2000 Langer et al. ..... 164/456

FOREIGN PATENT DOCUMENTS

DE 102518 2/1926
DE 295108 A5 10/1991
DE 19745471 A1 5/1998
EP 0838305 A1 4/1998
JP 57-184654 11/1982
JP 4-501386 3/1992
JP 5-285783 11/1993
JP 05285783 * 11/1993 ..... 29/561
JP 10-156664 6/1998
JP 11-28640 2/1999
WO WO 90/15684 12/1990

* cited by examiner

*Primary Examiner*—Kevin Kerns
*Assistant Examiner*—I.-H. Lin
(74) *Attorney, Agent, or Firm*—Flynn, Thiel, Boutell & Tanis, P.C.

(57) ABSTRACT

A method and an apparatus for machining a mold material to produce a mold. By casting based on a cast mold model (15), a mold material (20) is produced in a form having a work margin. Thereafter, a shape of the mold material (20) is measured by a measuring device (16), and measurement data and an envelope model (M2) generated based on the measurement data are stored in a storage unit (12A) of a computer (12). Thereafter, a mold model (M1) based on mold design data and an envelope model (M2) are displayed on a display unit (12C), and the envelope model (M2) is linearly moved in direction of three axes X, Y and Z orthogonal to one another respectively and rotated around the three axes to bring a product forming plane (M2B) of the envelope model (M2) into close proximity of a product forming plane (M1B) of the mold model (M1). Thereby, a state in which a work amount of a product forming plane (20B) of the mold material (20) is reduced is found, and a reference plane (20A) and a product forming plane (20B) of the mold material 20 are cut by a mold working machine (18) controlled by the computer (12).

4 Claims, 5 Drawing Sheets

METHOD AND APPARATUS FOR PRODUCING MOLD

CROSS-REFERENCE TO RELATED APPLICATION

The present application is a divisional of U.S. application Ser. No. 10/009,903 filed on Dec. 10, 2001now U.S. Pat. No. 6,953,077, which, in turn, is a Section 371 of PCT/JP01/03896 filed on May 10, 2001.

TECHNICAL FIELD

This invention relates to a method and an apparatus for producing a mold by machining a mold material produced by casting, and it can be used for production of a mold for pressing work, a mold for injection molding, and other molds.

BACKGROUND ART

On production of a mold for pressing, for example, with a casting as a material, machining such as cutting work and the like for long hours is conventionally required to finish a cast material that is to become a mold.

Specifically, after a member for a mold is cast, the mold member is machined and finished to be a mold, and on casting of the mold member, a large allowance or excess of mold material is present at the margin of the mold member that will require additional work by machining. This is because the cast mold model that is a basis of the mold member is manually produced in many cases, as well as that the precision of casting itself is low. Specifically, if the amounts of precision of a model and casting deformation are estimated, the margin requiring extra work becomes large from the viewpoint of compensating for the shrinkage that occurs during casting, thus making it necessary to prevent the cutting margin from running short.

As a waste portion of the cast mold model increases, the margin of the mold requiring extra work tends to be larger than necessary.

On the other hand, the mold industry is required to satisfy the demands for complicatedly shaped products formed from molds, while reducing the cost and lead time to produce the molds.

Accordingly, a reduction in the margin of the mold requiring work can be considered to reduce the machining time for a mold member, but even if a numerically controlled working machine or the like is used for production instead of manually making a cast mold model, a mold with high precision cannot be expected when a casting is used as the mold member, and as a result, the mold margin requiring work cannot be sufficiently reduced, which makes it impossible to reduce the machining time.

In view of the above-described fact, an object of the present invention is to provide a method and an apparatus for producing a mold capable of reducing a machining time after the casting of a mold member.

SUMMARY OF THE INVENTION

A method for producing a mold according to the present invention is characterized by the steps of producing a mold material by casting, obtaining measurement data by measuring a shape of the mold material by a measuring device, and working a reference plane and a product forming plane of the mold material by a mold working machine so as to reduce the amount of work required by the product forming plane of the mold material.

Thus, in the method for producing the mold, after the mold material is produced by casting, the shape of this mold material is first measured. Next, the reference plane and the product forming plane of the mold material is worked by the mold working machine based on the measurement data obtained above so as to reduce the amount of work required by the product forming plane of the mold material.

Since the product forming plane of the mold is a plane for forming a worked material such as a metal plate or the like in a predetermined shape, it is formed into a complicated shape, and thus the product forming plane of the mold member is also formed into a complicated shape. In the present invention, the reference plane and the product forming plane of the mold member are worked by the mold working machine so as to reduce the work amount required by the product forming plane of the mold material to produce the mold, and therefore the working time can be reduced and the work operation can be efficiently performed when the mold is produced by the machining work from the mold member, thus making it possible to reduce the cost and lead time of the mold.

If the working amount of the product forming plane of the mold member is reduced, the margin for work of the reference plane of the mold member is sometimes increased. However, the reference plane that is generally formed into a planar shape can be machined by a large cutter of the mold working machine, and as a result, working time and working cost never increase as a whole.

When the reference plane and the product forming plane of the mold member are worked by the mold working machine, the reference plane is initially worked, then the product forming plane is worked while the worked reference plane is used as a supporting surface of the mold member in the mold working machine.

According to the above, when the product forming plane is worked, the worked reference plane is made the supporting surface in the mold working machine, and therefore work can be performed with the reference plane being supported and fixed on a table of the mold working machine, thus making it possible to machine the product forming plane while being stabilized, thereby providing high precision.

Further, when the product forming plane is worked by the mold working machine, the product forming plane is worked after the decision as to what portions of the product forming plane are to be machined and how many times they are machined.

According to the above, it becomes possible to finish the production, for example, by machining only the portions with larger working margins of the product forming plane twice and by machining the portions with smaller working margins only once. It becomes unnecessary to perform machining many times while detecting what portions of the product protruded past an acceptable border by moving the cutter of the mold working machine over the entire product forming plane. Additionally, air cutting time, in which the cutter is moving but not working the mold member, can be reduced.

The method for producing the mold as described above can be carried out by measuring the shape of the mold member with the measuring device and working the reference plane and the product forming plane of the mold member with the mold working machine based on the data obtained by this measurement. These operation steps are independent from each other, but the process can be also carried out by dependent operation steps using a computer.

When the process is carried out by dependent operation steps using a computer, the measurement data obtained by the measuring device is sent to the computer, and after the computer performs a computation to reduce a work amount when working the product forming plane of the mold member with the mold working machine based on this measurement data and mold design data stored in the computer, the computer controls the mold working machine to work the mold member.

In order to perform a computation to reduce a work amount when working the product forming plane of the mold material with the mold working machine, an envelope model of the mold member generated based on the measurement data from the measuring device and a mold model generated based on the mold design data are displayed by a display means of the computer. Then the envelope model is moved in directions of three axes orthogonal to one another respectively and rotated around the three axes in this display means, thereby bringing this envelope model into close proximity of the mold model, and at the time of its being in close proximity thereof, the computer performs the computation to reduce the work amount of the product forming plane.

Bringing the envelope model into close proximity of the mold model means placing all the parts of the mold model inside the envelope model, and bringing a product forming plane of the envelope into close proximity of the product forming plane of the mold model. Thus, from the positional relationship between the mold model and the envelope model, the computation to reduce the work amount of the product forming plane can be performed by the computer with assurance and high precision.

Further, in the case in which a cast mold model is used to produce the mold material and is produced with a cast mold model working machine, this cast mold model working machine receives the data from the aforementioned computer to produce the cast mold model, and an estimated amount of deformation occurring when the mold member is produced by casting may be stored in the computer and may be sent to the cast mold model working machine.

According to the above, the cast mold model is formed, by the cast mold model working machine, into a shape and dimension that includes the estimated amount of deformation occurring when the mold member is produced by casting, and the mold member formed from the cast mold model can be formed accurately even if casting deformation occurs.

As in the above, when the estimated amount of casting deformation is stored in the computer, it is preferable to reset the estimated amount with the measurement data of the mold member measured with the measuring device.

When the estimated amount is reset as above, the estimated amount can be rewritten to represent more accurate data that is based on the shape and the dimension of the mold member actually produced by casting, and the next production of the mold member can be carried out more accurately.

When the method for producing the mold described above is carried out by using the computer, one computer may be used, or a plurality of computers performing data communications may be used.

An apparatus for producing a mold according to the present invention is an apparatus for carrying out the method for producing the mold explained above with the use of a computer.

Accordingly, an apparatus for producing a mold according to the present invention comprises a measuring device for measuring a shape of a mold member produced by casting, a computer into which measurement data from this measuring device is inputted, and a mold working machine controlled by the computer to work the mold member and produce a mold from the mold member, and the computer has storage means for storing the aforementioned measurement data and mold design data, and computing means for computing data for making the mold working machine work a reference plane and a product forming plane of the mold member to reduce a work amount of the product forming plane of the mold member based on the measurement data and model design data.

The computing means previously makes the mold working machine work the reference plane, and thereafter computes data for making the mold working machine work the product forming plane with the worked reference plane acting as a supporting surface of the mold member in the mold working machine.

Further, the working capability data of the mold working machine is stored in the storage means, and after the computing means computes what portions of the product forming plane are worked and how many times they are worked based on the working capability data, the computing means makes the mold working machine work the aforementioned product forming plane.

Furthermore, the computer has display means for displaying an envelope model of the mold member generated on the basis of the measurement data obtained by the measuring device and a mold model generated based on the mold design data, and operation means for bringing the envelope model into close proximity of the mold model by moving the envelope model in directions of three axes orthogonal to one another respectively and rotating it around the three axes, and by its being in close proximity thereof, the computation to reduce the work amount of the product forming plane is performed in the aforementioned computing means.

Bringing the envelope model into close proximity of the mold model mentioned here means placing all parts of the mold model inside the envelope model as well as bringing a product forming plane of the envelope into close proximity of the product forming plane of the mold model.

When the apparatus for producing the mold according to the present invention further comprises a cast mold model working machine for producing a cast mold model used for producing the mold material, an estimated amount of deformation at the time of casting of the mold member is stored in the aforementioned storage means, data including this estimated amount is sent to the cast mold model working machine, and the cast mold model is produced by the cast mold model working machine based on this data.

It is preferable to make the aforementioned estimated amount stored in the storage means resettable based on the measurement data about the shape of the mold member measured with the measuring device. When the estimated amount stored in the storage means is the measurement data by the measuring device and resettable, the next production of the mold member can be performed more accurately as described above.

In the above, the storage means of the computer may comprise any type of storage familiar in the art, including a magnetic disc, floppy-disk, hard disk, optical disk (CD-ROM, CD-R, CD-RW, DVD, etc.), magneto-optic disk (MO, etc.), semiconductor memory, magnetic tape or the like, and may be the combination of two or more of them.

Further, the operation means may comprise any one or more operation devices, including a keyboard, mouse, track ball, joystick, or the like, and may be the combination of two or more of them.

Furthermore, the display means may be a display device such as a display with a visual screen, printer, or the like, but since it is desired to visually show the envelope model being brought into close proximity of the mold model as described above, the display with a screen is preferable.

The computer in the above apparatus for producing the mold may be one, or may be a plurality of computers performing data communications.

An example of a mold to which the method and apparatus for producing the mold according to the present invention is applied is a press mold for pressing work, but other than this, it is also applicable to the production of molds for injection molding, extrusion molding, pultrusion, blow molding and the like.

Further, when the accurate height dimension of the mold is required, the work amount of the reference plane is set according to the height dimension, but if it is sufficient to form the reference plane of the mold member to be simply a parallel plane with the reference plane of the mold model, the reference plane may be worked to be parallel therewith. In this case, the work amount of the reference plane can be further reduced.

Further, the measuring device for measuring the shape of the mold material may be a device of a non-contact image-pickup type using moire, non-contact laser type or stereo type, or further a device for measuring in contact with the mold member.

Furthermore, machining of the mold member may be cutting work, grinding work or the like, or the combination of them. Further, as the cutter for working the mold member, an end mill and the like can be considered, and as a mold working machine, adopting a machining center and the like are considered. If the mold working machine is a numerically controlled machine tool, machining work of the mold member can be accurately and efficiently performed by utilizing the data from the computer.

BEST MODE FOR CARRYING OUT THE INVENTION

Preferred embodiments will be described with reference to the attached drawings in order to further explain the present invention in detail.

A configuration and procedural steps of a mold production support system for carrying out a method for producing a mold according to an embodiment of the present invention will be explained based on the drawings.

Figure 1:
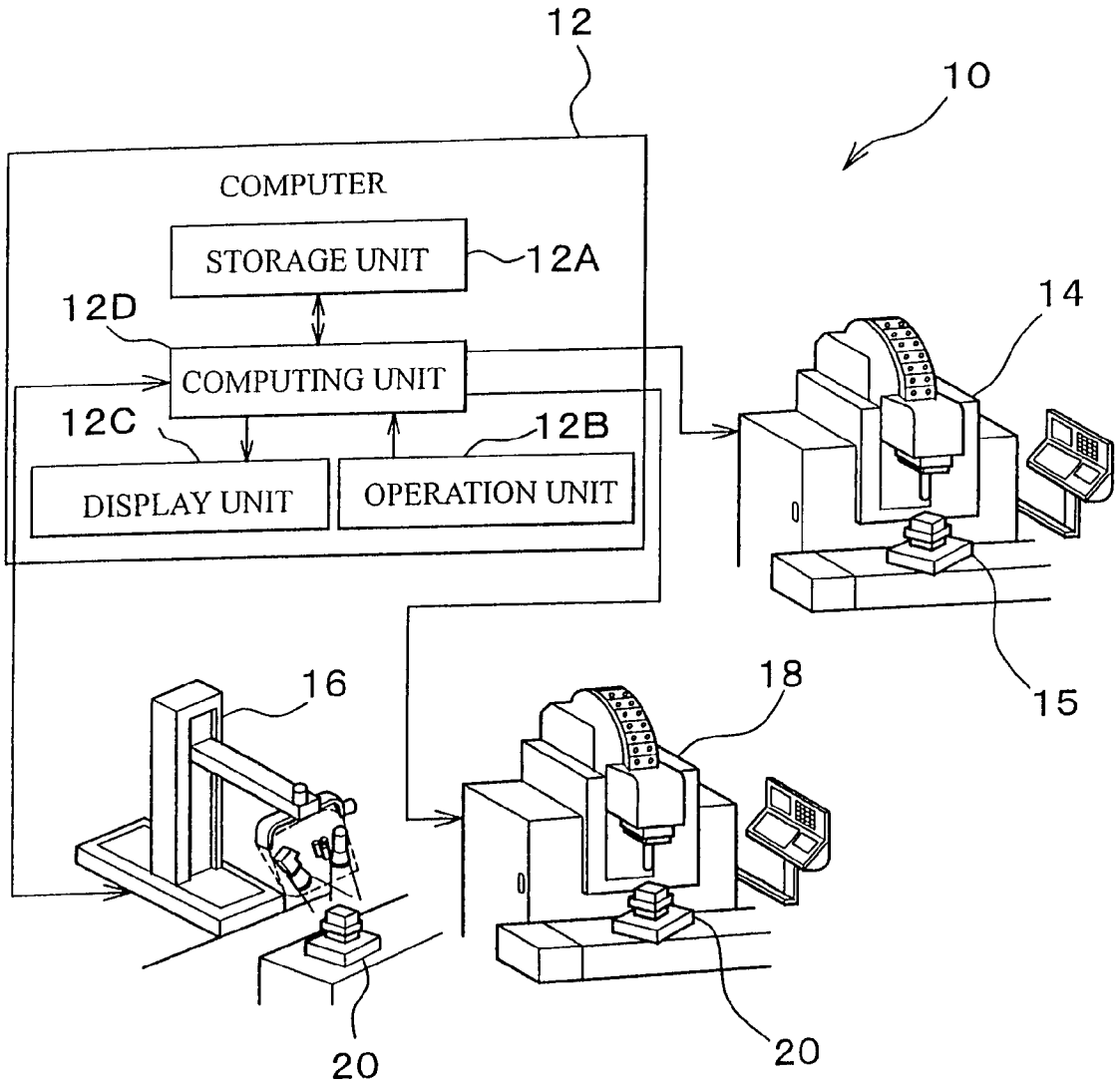
FIG. 1 is a block diagram of a mold production support system applied to a method for producing a mold according to one embodiment of the present invention.

As shown in FIG. 1, a computer 12 loaded with computer aided design and manufacturing (CAD/CAM) software and constituting a core part of a mold production support system 10, is connected to a cast mold model working machine 14 that is a numerically controlled (NC) machine tool for producing a cast mold model 15. The cast mold model 15 is worked by this working machine 14 based on the mold design data sent from the computer 12. The cast mold model 15 is formed in a shape corresponding to a mold member 20 for a press mold produced by casting. Computer 12 stores various types of data, including an estimated amount of mold deformation caused by casting, which is sent to the cast mold model working machine 14, where the mold member 20 is produced by casting. Furthermore, the shape of the mold member 20 is cast based on the cast mold model 15 so as to have a shape and dimension that includes a margin requiring extra work being left, thereby requiring additional cutting work to be performed after the production of the mold member 20. The cast mold 15 may be manually produced.

A measuring device 16 for measuring the shape of the mold member 20 is also connected to the computer 12. The measuring device 16 is a three-dimensional measuring device utilizing an image-pickup type moire, and which is capable of hexaxially controlling the direction of a camera and simultaneously processing many points of an image. The computer 12 is loaded with shape measuring support system software capable of giving an automatic tracking command to the measuring device 16, so that the effective shape measurement of the mold member 20 can be made.

Figure 4:
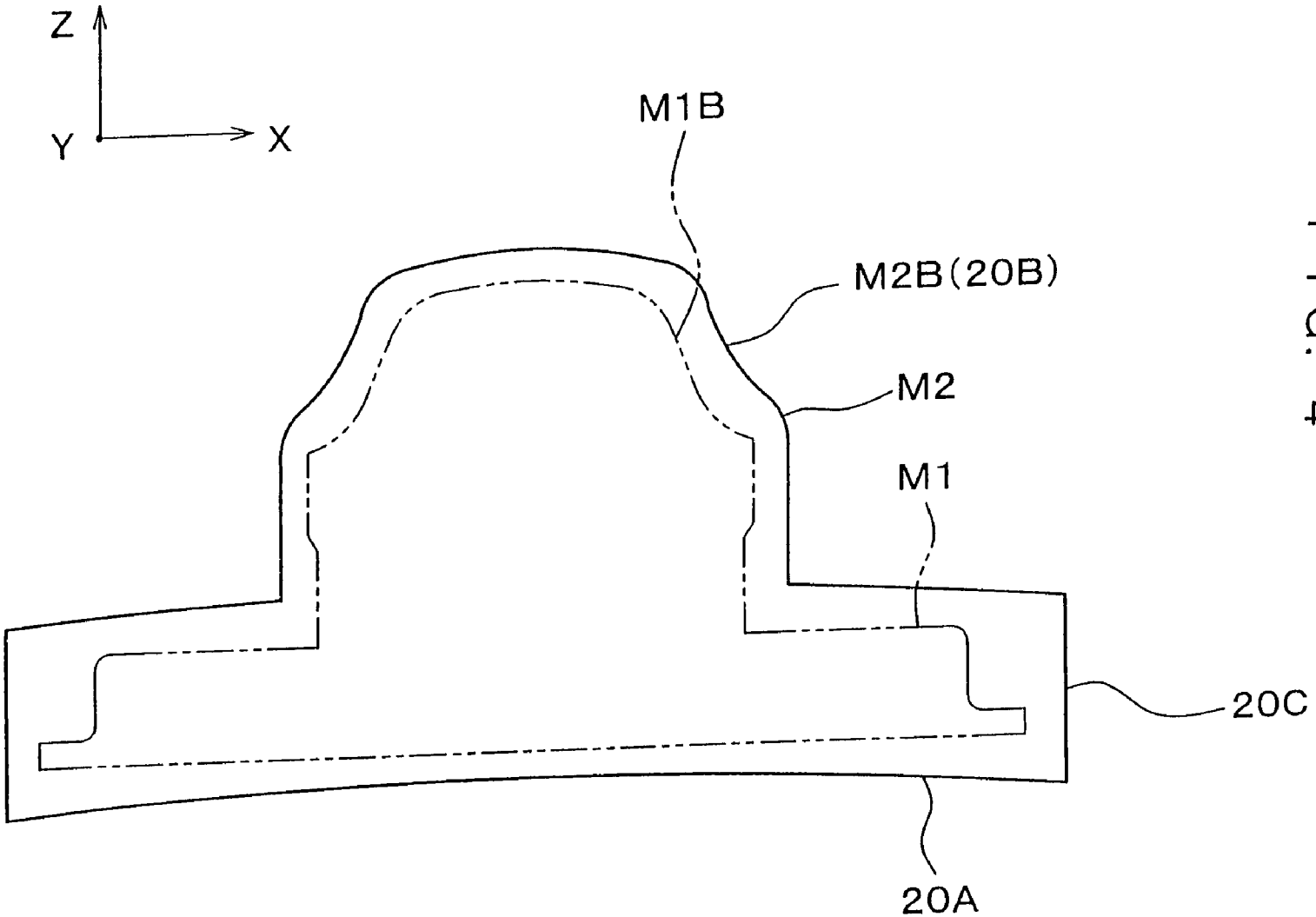
FIG. 4 is a view showing positional relationship between an envelope model and a mold model.

The measurement data of the mold member 20, as measured by the measuring device 16, comprises a group of measured points. The measurement data is sent to the computer 12 as an envelope model M2, as shown in FIG. 4, that comprises a three-dimensional graphic model virtually formed along the measured group of points.

Further, a mold working machine 18 being an NC machine tool for working the mold member 20 is also connected to the computer 12, so that the mold member 20 can be worked by the mold working machine 18 based on the measurement data measured with the measuring device 16.

The computer 12 has a storage unit 12A, an operation unit 12B, a display unit 12C and a computing unit 12D. The storage unit 12A stores the aforementioned software, mold design data and data concerning an estimated amount of casting deformation, along with data concerning the working capability of the mold working machine 18, as well as the software necessary for computing the amount of work by which the mold member 20 is cut based on the mold design data and the measurement data from the measuring device 16. Also stored is the software and data necessary for carrying out the mold producing method, including, for example, software for driving the cast mold model working machine 14 and software for finishing the mold member 20 by the mold working machine 18 based on the measurement data from the measuring device 16. The computing unit 12D performs the execution of the software stored in the storage unit 12A based on a command signal from the operation unit 12B and computing processing based on the data stored in the storage unit 12A. The display unit 12C is a display with a visual screen which displays the result of computing processing by the computing unit 12D.

According to the above, the mold production support system 10 is an apparatus for producing a mold, and comprises the computer 12, the casting mold model working machine 14, the measuring device 16 and the mold working machine 18, with the casting mold model working machine 14, the measuring device 16 and the mold working machine 18 being controlled by the computer 12.

Figure 2:
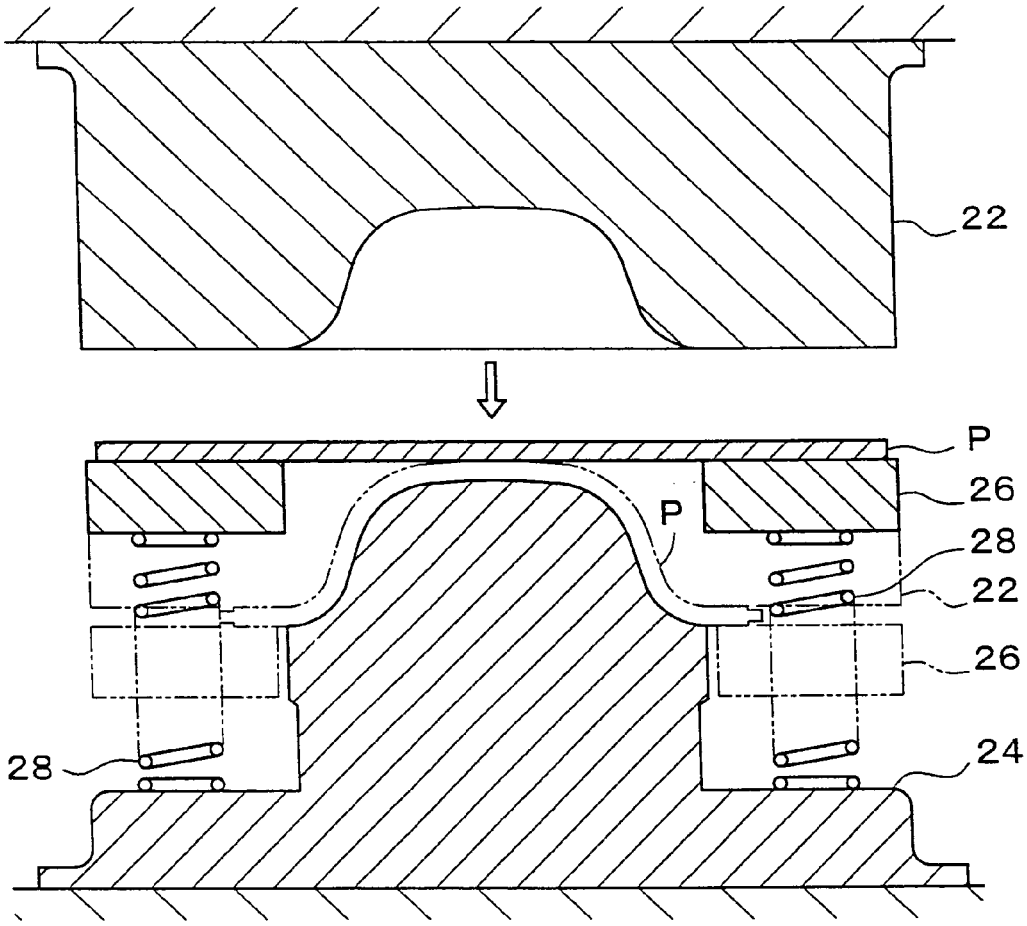
FIG. 2 is a sectional view showing a construction of a press mold apparatus.

The mold member 20 of this embodiment is finished into a mold by being subjected to cutting work by the mold working machine 18. The finished mold subsequently becomes part of a press mold apparatus that includes, for example, an upper mold 22 disposed on an upper portion side as shown in FIG. 2, while a lower mold 24 is disposed on a lower portion side. A lower holder 26 for pressing a metal plate P between the lower holder 26 and the upper mold 22 is disposed between the upper and lower molds by being supported by springs 28. When the upper mold 22 is lowered as the two-dot chain lines show, the metal plate P becomes sandwiched between the upper mold 22 and the lower holder 26 and is worked by pressing the upper mold 22 down onto the lower mold 24, thereby forming the product.

Figure 3:
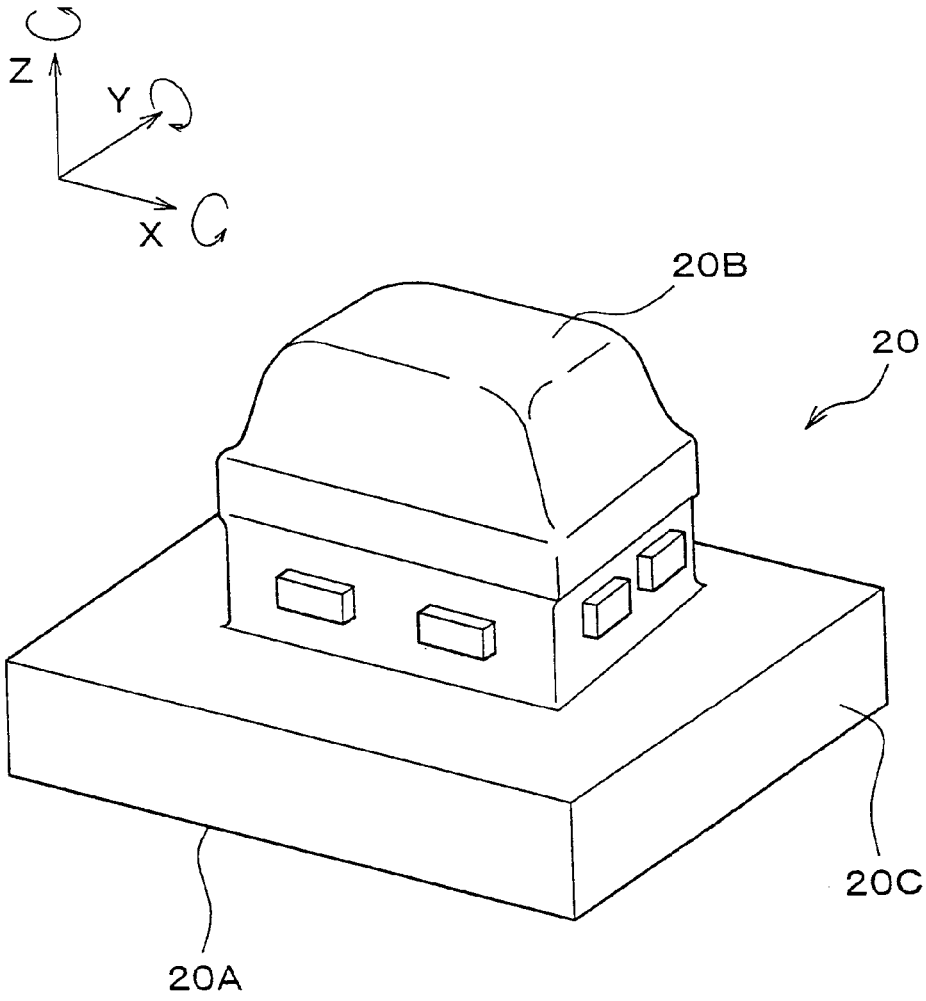
FIG. 3 is a perspective view showing a mold material for an upper mold of the press mold apparatus.

On producing molds such as the upper mold 22, lower mold 24, the lower holder 26 and the like, the production method provided in the current embodiment is used to produce, for example, a mold member 20 that corresponds to the lower mold 24 as shown in FIG. 3.

Next, the steps for producing a mold according to this embodiment will be explained.

First, the cast mold model working machine 14 cuts a material, such as foam resin, based on the mold design data sent from the storage unit 12A of the computer 12 to thereby cut and create the cast mold model 15 that corresponds to the mold member 20. Next, a casting operation is performed, such as, for example, the lost-wax casting process. The cut cast mold model 15 is used to create a mold of mold member 20. Mold member 20, an example of which is shown in FIG. 3 is subsequently made in a form having an allowance or excess of mold material present at the margin of the mold member 20 that requires further machine work.

Thereafter, the shape of the mold member 20 is measured by the measuring device 16, with the resulting measurement data used to generate an envelope model M2 that becomes stored in the storage unit 12A of the computer 12.

Further, after measuring the shape of the mold member 20, a reference plane 20A, a product forming plane 20B, and a surface 20C of the mold member 20 is cut by the mold working machine 18.

On this occasion, the mold design data and measurement data are initially read from the storage unit 12A of the computer 12 and shown on the display unit 12C so that an operator can see the positional relationship between a mold model M1, being a three-dimensional graphic model based on the mold design data, and the envelop model M2, being the three-dimensional graphic model based on the measurement data, as shown in FIG. 4.

In the state shown on the display, the envelope model M2 of the mold member 20, as based on the measurement data, is linearly moved in directions of the axes X, Y and Z orthogonal to one another and also rotated around the three axes X, Y and Z by the operation of the operation unit 12B. It is noted that the envelope model M2 can be linearly moved and rotated automatically by software.

Figure 5:
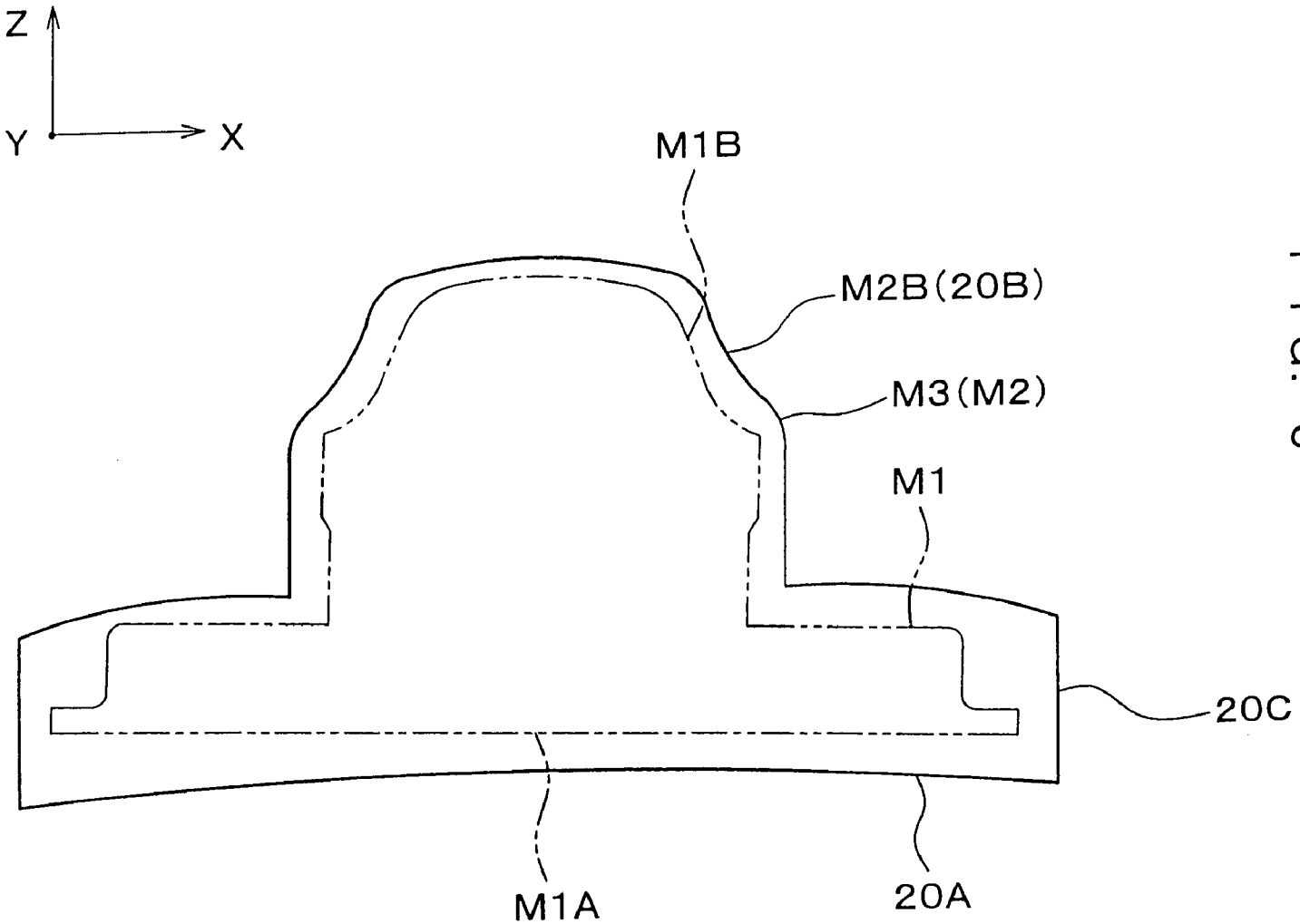
FIG. 5 is a view showing positional relationship between a scanning measured model and the mold model.

By linearly moving and rotating the envelope model M2, all parts of the mold model M1 is placed inside the envelope model M2, and by bringing the envelope model M2 into close proximity of the mold model M1 as shown in FIG. 5, specifically, by bringing the product forming plane M2B of the envelope model M2 into close proximity of a product forming plane M1B of the mold model M1, the amount of work on the product forming plane 20B of the mold member 20 is minimized and the overall amount of work is reduced.

Upon determining the state in which the amount of work on the product forming plane 20B becomes minimized, the position of the envelope model M2 is fixed in this state by a command signal from the operation unit 12B, and the data of the envelope model M2 at this time is converted into the coordinate axis of the mold model M1, and the three-dimensional graphic model of the obtained data is called a scanning measured model M3.

By obtaining the amount of cutting required by each portion of the reference plane 20A, product forming plane 20B, and the like of the mold member 20 by the computing unit 12D based on the size of a gap between the scanning measured model M3 and the mold model M1, the volume of the cut portions of the mold member 20 is calculated, and this volume is set as the total cutting amount of the mold member 20.

Based on the data of the total cutting amount, the computing unit 12D of the computer 12 not only computes the diameter, rotational frequency, cutting amount, feeding speed and the like of the cutter of the mold working machine 18, but also computes what portions of the product forming plane 20B are cut and how many times they are cut when cutting the product forming plane 20B, based on the working capability data of the mold working machine 18 stored in the storage unit 12A. Specifically, the data that makes it possible to reduce the work amount of the product forming plane 20B is computed by the computing unit 12D from the data stored in the storage unit 12A.

Thereafter, the reference plane 20A, the product forming plane 20B, and the surface 20C of the other parts are respectively cut by the mold working machine 18, on which occasion, a reference plane working instruction diagram dimensionally indicating the position of the reference plane 20A and the position of the support surface M1A of the mold model M1 from the position of the platen of the virtual mold working machine is initially generated in the computing unit 12D of the computer 12 using the scanning measured model M3. This reference plane instruction diagram is then outputted to the mold working machine 18, and the reference plane 20A, being a large plane, is first cut with the mold working machine 18.

After the cutting work of the reference plane 20A is finished and the surface 20C of the other part is cut, the product forming plane 20B of the mold member 20 is cut with the reference plane being fixedly supported on a table of the mold working machine 18 as the supporting surface.

On this occasion, based on the computation result from the data of the aforementioned total cutting amount, the diameter, rotational frequency, cutting amount, feeding speed and the like of the cutter of the mold working machine 18 are selected, and predetermined portions of the product forming plane 20B is worked at predetermined times, whereby the work of the entire product forming plane 20B is finished while the work amount is reduced.

Next, the operation of the method for producing the mold according to this embodiment will be explained.

In this embodiment, based on the measured shape of the mold member 20 stored in the storage unit 12A of the computer 12, the envelope model M2 of the mold member 20 is generated and capable of being displayed on the display unit 12C. Subsequently, the envelope model M2 is linearly movable in the directions of the three axes X, Y and Z orthogonal to one another and rotatable around the three axes. Thus, in such a manner, the envelope model M2 can be brought into close proximity to the mold model M1 that is generated based on the mold design data and compared.

As a result of the above, the positional relationship between the mold model M1, based on the mold design data, and the mold member 20 can be determined with reliability and high precision, making it possible to reduce the work amount of the product forming plane 20B that takes time to be machined.

When the reference plane 20A and the product forming plane 20B of the mold member 20 are cut by the mold working machine 18, the reference plane 20A of the mold member 20 is initially cut, and the product forming plane 20B is cut with the worked reference plane 20A as the supporting surface in the mold working machine 18. Consequently, when the product forming plane 20B is worked, the worked reference plane 20A can be fixed on the table of the mold working machine 18 as the supporting surface, and thereby the mold member 20 is fixed on the table with stability, thus making it possible to work the product forming plane 20B with higher precision and assurance.

Further, when the cutting work is performed for the product forming plane 20B, what portions are cut and how many times they are cut are computed in the computing unit 12D, thus making it possible to finish the production by cutting only the portions having a larger margin for work of the product forming plane 20B, for example, twice, and by cutting the portions having a smaller margin for work only once.

It becomes unnecessary to perform a cutting operation numerous times while detecting what portions of the mold member 20 protrude beyond an acceptable boundary by moving a cutting tool and the like over the entire product forming plane 20B, and it becomes possible to reduce the time of air cutting during which the tool is moving but not machining the mold member.

According to the above, when the reference plane 20A and the product forming plane 20B of the mold member 20 are worked on, the margin for work required by the product forming plane 20B is reduced. Consequently, the amount of work required to produce the product forming plane 20B, which is a plane for forming the pressed material such as a metal plate and the like into a product as a mold for pressing work and which is generally regarded to have a complicated surface shape, is reduced.

Even when a casting with a low precision is used as a mold member, the work amount required by the product forming plane 20B is reduced and the cutting time can be shortened, thus making it possible to generate complicated product shapes while reducing the cost and lead time of the molds.

In an alternative embodiment, the margin of work required by the reference plane 20A is larger in some cases compared to the above examples. However, the reference plane 20A, which is generally planar, can be cut by a large cutter, thereby preventing the cutting time from increasing a large extent when the reference plane 20A is worked on.

Next, the cutting time reduction effects by the method and apparatus for producing the mold according to this embodiment will be explained.

Conventionally, when the cutting work machining is performed for the mold material, the work is carried out in multiple stages such as rough machining, semi-finishing machining, finishing machining, and the like. When the condition for cutting a material having the same shape as the product forming plane is by rough machining, the cutter with a diameter of 50 mm is used, and when the cutting amount is 10 mm and the rotational frequency is 800 rpm, the feeding speed is 0.4 m/minute.

On the other hand, as the work amount of the production forming plane is reduced by adopting the production method of this embodiment, the cutting amount is 4 mm, and when the cutter of a diameter of 50 mm is used at the rotational frequency of 1400 rpm, the condition of the feeding speed of 1.05 m/minute is obtained, thereby increasing the cutting speed by a factor of 2.6 compared to conventional methods.

Further, the cutting time for the entire mold member under this working condition is estimated to be shorter by about 32% as compared with the prior art, and the working time for producing the lower holder is reduced by about 10 hours.

Adoption of the production method according to the present embodiment allows the rough machining stage to be eliminated. Instead, machining is performed with a cuter for the semi-finishing machining stage with a cutting amount of 3 mm at a reduced feed speed, resulting in the rotational frequency becoming 1800 rpm with a feeding speed of 1.45 m/minute being obtained. In contrast, the conventional process of semi-finishing machining requires a rotational frequency of 2000 rpm with a cutting amount of 0.2 mm and a feeding speed of 2 m/minute.

In the present embodiment, the cutting speed of the semi-finishing machining stage becomes lower as a result of the cutting speed being about 0.7 times as high as the conventional one. However, it is compensated by the time saved by elimination of the rough machining stage, and the work time when the lower holder is produced for trial can be reduced by about 13 hours, thus making it possible to improve the efficiency to a large extent.

Next, an analysis of the amount of deformation caused by casting the mold member 20 through use of the mold production method according to the present embodiment will be explained. The deformation occurs in the form of shrinkage and the like when the mold material is produced by casting.

Data relating to an estimated amount of casting deformation is stored in the storage unit 12A of the computer 12 to produce the cast mold model 15 shown in FIG. 1, and the actual dimension of the mold member 20 based on the measurement data obtained by the measuring device 16 is compared. According to the above, the operator of the mold production support system 10 can judge whether or not the estimated amount of casting deformation will be corrected when the next mold member 20 is produced, and analyze the difference between the estimated amount of the casting deformation and the actual dimension of the mold member 20.

Based on the difference between the actual casting deformation amount and the estimated casting deformation amount, it is determined whether or not the estimated casting deformation amount stored in the storage unit 12A is proper or not, and in the next production of the mold member 20, the estimated amount of the casting deformation can be reset.

The reset estimated amount of casting deformation is stored in the storage unit 12A, and when the cast mold model 15 for producing the next mold member 20 is produced, data of the estimated casting deformation amount is sent to the casting mold model working machine 14, whereby the cast mold model 15 is produced in the appropriate shape and dimension including the estimated amount.

INDUSTRIAL AVAILABILITY

As in the above, the method and apparatus for producing the mold according to the present invention is suitable for producing a mold used for pressing work and the like.

What is claimed is:

1. An apparatus for producing a mold, comprising:

a measuring device for measuring a shape of a mold material produced by casting;

a computer into which measurement data from the measuring device is inputted; and a mold working machine controlled by the computer to work the mold material and produce a mold from the mold material, wherein the computer comprises storage means for storing the measurement data, mold design data and working capability of the mold working machine, computing means for computing data for making said mold working machine work a reference plane and thereafter computes data for making the mold working machine work the product forming plane with the worked reference plane as a supporting surface of the mold material in the mold working machine to reduce a work amount of the product forming plane of the mold material based on the measurement data and mold design data, display means for displaying an envelope model of the mold material generated based on the mold design data and operation means for bringing the envelope model into close proximity of the mold model by moving the envelope model in directions of three axes orthogonal to one another and rotating it around the three axes, and by its being in close proximity thereof, the computation to reduce the work amount of the product forming plane is performed in the computing means, bringing the envelope model into close proximity of the mold model means placing all parts of said mold model inside said envelope model and bringing a product forming plane of said envelope into close proximity of the product forming plane of the mold model, and after computing what portions of the product forming plane are worked and how many times they are worked, based on the working capability data, the computing means makes the mold working machine work the product forming plane.

2. The apparatus for producing the mold according to claim 1, further comprising a cast mold model working machine for producing a cast mold model used for producing said mold material, wherein an estimated amount of deformation at the time of casting of said mold material is stored in said storage means, data including this estimated amount is sent to said cast mold model working machine, and said cast mold model is produced by said cast mold model working machine based on this data.

3. The apparatus for producing the mold according to claim 2, wherein said estimated amount stored in said storage unit is resettable based on said measurement data.

4. The apparatus for producing the mold according to claim 1, wherein said mold working machine comprises a numerically controlled machine tool.

* * * * *